US012649214B2

(12) United States Patent
Bae et al.

(10) Patent No.: US 12,649,214 B2
(45) Date of Patent: Jun. 9, 2026

(54) POLISHING APPARATUS

(71) Applicant: Samsung Display Co., LTD., Yongin-si (KR)

(72) Inventors: Junhee Bae, Yongin-si (KR); Jinsoo Shin, Yongin-si (KR); Hyunhee Lee, Yongin-si (KR); Seungpyo Hong, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 413 days.

(21) Appl. No.: 18/384,141

(22) Filed: Oct. 26, 2023

(65) Prior Publication Data

US 2024/0139911 A1 May 2, 2024

(30) Foreign Application Priority Data

Oct. 27, 2022 (KR) ..... 10-2022-0140728

(51) Int. Cl.
*B24D 3/20* (2006.01)
*B24D 3/34* (2006.01)

(52) U.S. Cl.
CPC *B24D 3/20* (2013.01); *B24D 3/34* (2013.01)

(58) Field of Classification Search
CPC . B24D 5/066; B24D 5/02; B24D 5/14; B24D 13/12; B24D 3/10; B24D 3/20; B24B 41/053; B24B 9/10; B24B 9/08; B24B 7/242; B24B 7/24
See application file for complete search history.

(56) References Cited

U.S. PATENT DOCUMENTS

| | | | | | |
|---|---|---|---|---|---|
| 3,067,551 | A * | 12/1962 | Maginnis | B24D 5/14 | 451/49 |
| 5,626,511 | A * | 5/1997 | Kennedy | B24B 9/146 | 451/461 |
| 5,899,796 | A * | 5/1999 | Kamiyama | F16L 55/265 | 451/178 |
| 10,150,204 | B2 * | 12/2018 | Baratti | B24D 9/08 | |
| 10,825,837 | B2 * | 11/2020 | Kuon | H10D 86/60 | |
| 2017/0043452 | A1 * | 2/2017 | Daniels | B24D 18/0009 | |
| 2021/0114171 | A1 * | 4/2021 | Sventek | B24D 11/003 | |

FOREIGN PATENT DOCUMENTS

| | | | | |
|---|---|---|---|---|
| JP | 2008290190 | A | 12/2008 | |
| JP | 2022008022 | A | 1/2022 | |
| KR | 100662970 | B1 | 12/2006 | |
| KR | 100790554 | B1 | 1/2008 | |
| KR | 1020180051555 | A | 5/2018 | |
| KR | 1020190007867 | A | 1/2019 | |
| WO | WO-2019229610 | A1 * | 12/2019 | B24D 13/20 |

* cited by examiner

*Primary Examiner* — Abiy Teka
(74) *Attorney, Agent, or Firm* — CANTOR COLBURN LLP

(57) ABSTRACT

A polishing apparatus includes a shank including a rotation shaft extending in a first direction, a first cushion unit covering a side surface of the shank and having a first hardness, a first film unit adjacent to the first cushion unit in a second direction crossing the first direction and covering a side surface of the first cushion unit, a second cushion unit disposed below the shank, having a second hardness different from the first hardness, and including a first part and a second part. The first part has a cylindrical shape and the second part is disposed below the first part and has a conical shape protruding in a direction opposite to the first part, and a second film unit covering the second part.

20 Claims, 7 Drawing Sheets

POLISHING APPARATUS

This application claims priority to Korean Patent Application No. 10-2022-0140728, filed on Oct. 27, 2022, and all the benefits accruing therefrom under 35 U.S.C. § 119, the content of which in its entirety is herein incorporated by reference.

BACKGROUND

1. Field

Embodiments relate to a polishing apparatus. More particularly, embodiments relate to a polishing apparatus polishing a cover window.

2. Description of the Related Art

As information technology develops, an importance of a display device, which is a connection medium between a user and information, is emerging. As a result, a use of display device such as liquid crystal display device, organic light-emitting display device, and plasma display device is increasing.

The display device may include a display panel displaying an image and a cover window disposed on the display panel to protect the display panel. The cover window may be processed to have various shapes (e.g., a three-dimensional shape) as desired. The cover window may be processed by computer numerical control ("CNC") machining, for example.

SUMMARY

Embodiments provide a polishing apparatus with improved quality.

A polishing apparatus in an embodiment includes a shank including a rotation shaft extending in a first direction, a first cushion unit covering a side surface of the shank and having a first hardness, a first film unit adjacent to the first cushion unit in a second direction crossing the first direction and covering a side surface of the first cushion unit, a second cushion unit disposed below the shank, having a second hardness different from the first hardness, and including a first part and a second part. The first part has a cylindrical shape and the second part is disposed below the first part and has a conical shape protruding in a direction opposite to the first part, and a second film unit covering the second part.

In an embodiment, the first hardness may be greater than the second hardness.

In an embodiment, the first hardness may be about Shore A40 or more and about Shore A50 or less.

In an embodiment, the second hardness may be about Shore A20 or more and about Shore A30 or less.

In an embodiment, each of the first film unit and the second film unit may have a microstructure of a repeated triangular lattice pattern.

In an embodiment, an angle defined by a side surface of the second part and the second direction may be about 3 degrees or more and about 20 degrees or less.

In an embodiment, the second cushion unit may cover a lower portion of the shank, a lower portion of the first cushion unit, and a lower portion of the first film unit.

In an embodiment, the shank may have a cylindrical shape.

In an embodiment, a thickness of the first cushion unit in the second direction may be about 2 mm or more.

In an embodiment, a thickness of the first part in the first direction may be about 2 mm or more.

In an embodiment, a thickness of the first film unit in the second direction may be greater than a thickness of the first cushion unit in the second direction.

In an embodiment, a thickness of a central portion of the second part in the first direction may be greater than a thickness of the first part in the first direction.

In an embodiment, each of the first cushion unit and the second cushion unit may include at least one of rubber, silicon (Si), and thermoplastic polyurethane ("TPU").

In an embodiment, each of the first film unit and second film unit may include at least one of diamond powder, selenium dioxide ($SeO_2$), and silicon carbide (SiC).

A polishing apparatus in an embodiment includes a shank including a rotation shaft extending in a first direction, a first cushion unit including a first core covering a side surface of the shank and a first processing part covering a side surface of the first core. The first core has a first hardness, and a second cushion unit disposed below the shank, including a second hardness different from the first hardness, and having a second core and a second processing part, the second core has a first part and a second part disposed below the first part and the second processing part covers the second part, and the first part has a cylindrical shape and the second part has a conical shape.

In an embodiment, the first hardness may be greater than the second hardness.

In an embodiment, the first hardness may be about Shore A40 or more and about Shore A50 or less.

In an embodiment, the second hardness may be about Shore A20 or more and about Shore A30 or less.

In an embodiment, each of the first core and the second core may include at least one of rubber, silicon (Si), and TPU.

In an embodiment, each of the first processing part and the second processing part may include diamond powder and at least one of rubber, silicon (Si), and TPU.

A polishing apparatus in an embodiment includes a shank including a rotation shaft extending in a first direction, a first cushion unit covering a side surface of the shank and having a first hardness, a first film unit adjacent to the first cushion unit in a second direction crossing the first direction and covering a side surface of the first cushion unit, a second cushion unit disposed below the shank, having a second hardness different from the first hardness, and including a first part and a second part. The first part has a cylindrical shape and the second part is disposed below the first part and has a conical shape protruding in a direction opposite to the first part, and a second film unit covering the second part.

Accordingly, the film unit may be replaced whenever the film unit, which is a portion for processing the cover window, is worn. That is, the shape of the film unit may be kept constant. Accordingly, the cover window may be uniformly processed.

BRIEF DESCRIPTION OF THE DRAWINGS

Illustrative, non-limiting embodiments will be more clearly understood from the following detailed description in conjunction with the accompanying drawings.

DETAILED DESCRIPTION

Figure 1:
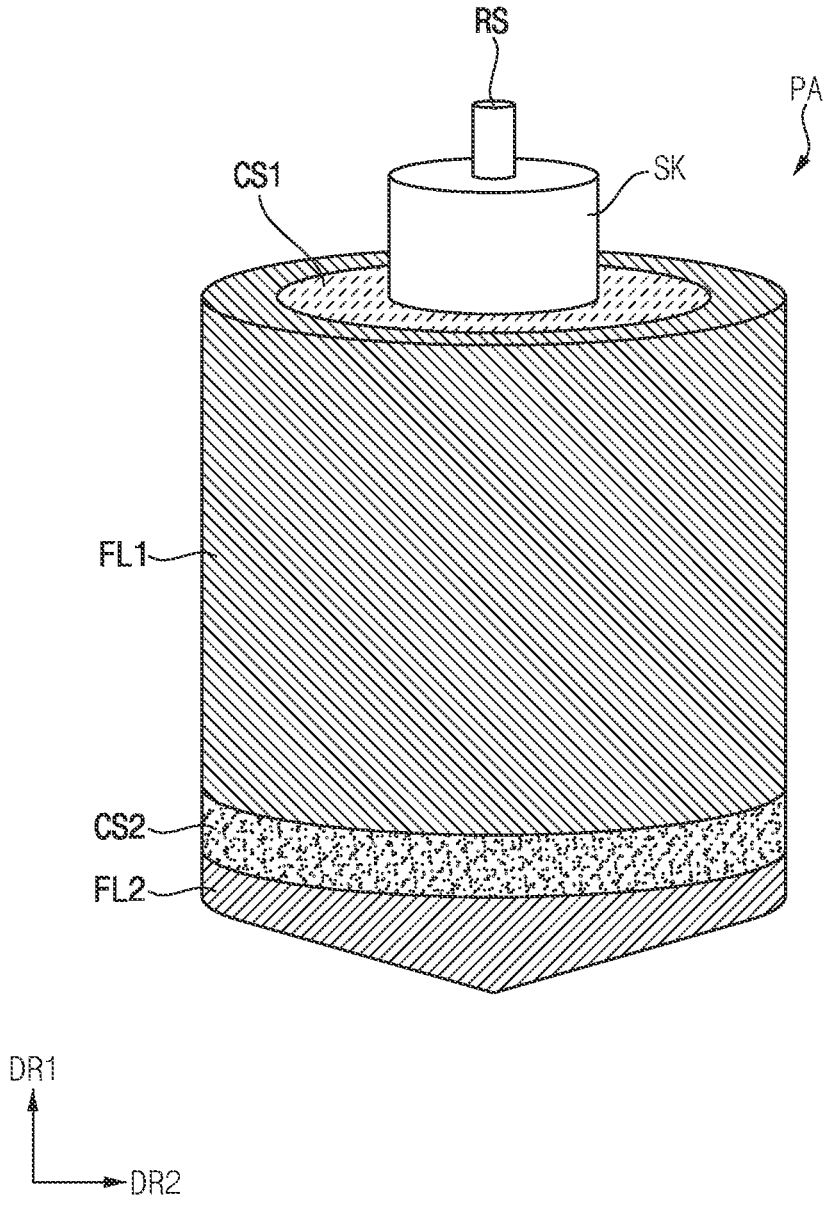
FIG. 1 is a perspective view illustrating an embodiment of a polishing apparatus.

Hereinafter, display devices in embodiments will be described in more detail with reference to the accompanying drawings. The same reference numerals are used for the same components in the drawings, and redundant descriptions of the same components will be omitted.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term such as "about" can mean within one or more standard deviations, or within ±30%, 20%, 10%, 5% of the stated value, for example.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 2:
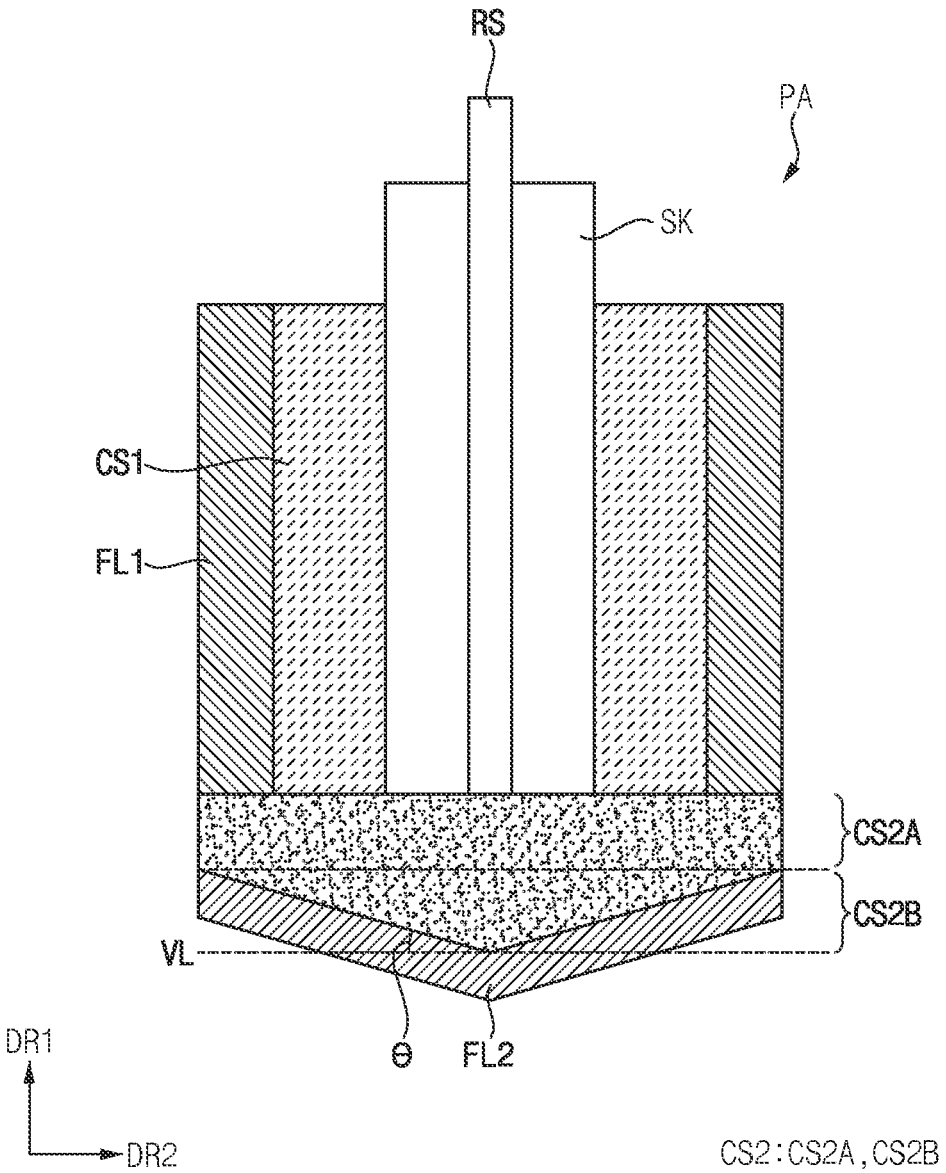
FIG. 2 is a cross-sectional view illustrating the polishing apparatus of FIG. 1.
Figure 3:
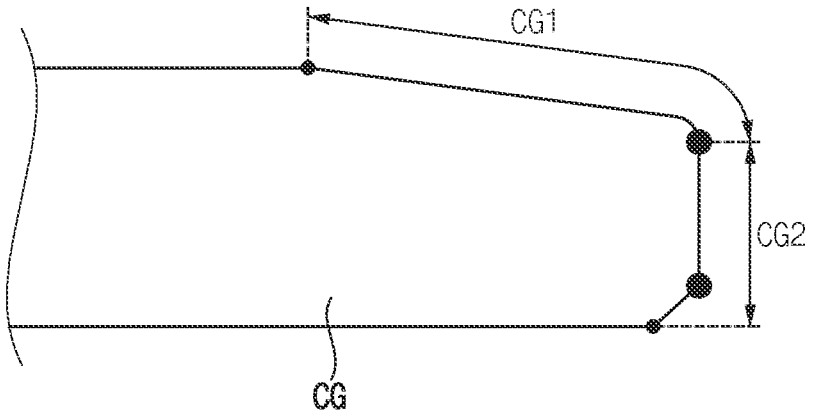
FIG. 3 is a diagram illustrating a portion of a cover window that may be polished using the polishing apparatus of FIG. 1.

FIG. 1 is a perspective view illustrating an embodiment of a polishing apparatus. FIG. 2 is a cross-sectional view illustrating the polishing apparatus of FIG. 1. FIG. 3 is a diagram illustrating a portion of a cover window that may be polished using the polishing apparatus of FIG. 1. In an embodiment, FIG. 2 may be a cross-sectional view taken along a perforated line passing through a central portion of the polishing apparatus PA of FIG. 1, for example.

Referring to FIGS. 1, 2, and 3, a polishing apparatus PA in an embodiment may include a shank SK, a first cushion unit CS1, a first film unit FL1, a second cushion unit CS2 including a first part CS2A and a second part CS2B, and a second film unit FL2.

The shank SK may include a rotation shaft RS. The rotation shaft RS may extend in the first direction DR1. That is, the polishing apparatus PA may rotate in the first direction through the rotation shaft RS. The shank SK may be disposed (e.g., mounted) within a chuck of a rotating machine, such as a computer numerical control ("CNC") machine. In an embodiment, the shank SK may have a cylindrical shape. In addition, the rotation shaft RS may have a cylindrical shape. For convenience of description, the rotation shaft RS may be omitted in FIGS. 6 and 8

A first cushion unit CS1 may cover a side surface of the shank SK. That is, the first cushion unit CS1 may be adjacent to the shank SK in a second direction DR2 crossing the first direction DR1. In an embodiment, the first cushion unit CS1 may have a cylindrical shape. That is, the first cushion unit CS1 may have a cylindrical shape through which the shank SK penetrates at the center of the cylindrical shape.

The first cushion unit CS1 may have a hardness of about Shore A40 or more and about Shore A50 or less. Preferably, the first cushion unit CS1 may have a hardness of about Shore A45. In an embodiment, a thickness of the first cushion unit CS1 in the second direction DR2 may be about 2 millimeters (mm) or more.

The first cushion unit CS1 may include rubber, silicon (Si), thermoplastic polyurethane ("TPU"), or the like. These materials may be used alone or in any combinations with each other. Unlike the first film unit FL1, which will be described later, the first cushion unit CS1 may not wear even when a cover window CG is processed several times. That is, the first cushion unit CS1 may not be replaced even after processing the cover window CG several times.

The first film unit FL1 may cover a side surface of the first cushion unit CS1. That is, the first film unit FL1 may be adjacent to the first cushion unit CS1 in the second direction DR2. In an embodiment, the first film unit FL1 may have a cylindrical shape. That is, the first film unit FL1 may have a cylindrical shape through which the shank SK and the first cushion unit CS1 penetrate at the center of the cylindrical shape.

The first film unit FL1 may include diamond powder, selenium dioxide (SeO2), silicon carbide (SiC), or the like. These materials may be used alone or in any combinations with each other.

The first film unit FL1 may directly contact the cover window CG when the polishing apparatus PA processes the cover window CG. Accordingly, the first film unit FL1 may be worn as the cover window CG is processed several times. Accordingly, the worn first film unit FL1 may be replaced with a new first film unit FL1. Preferably, the first film unit FL1 may be replaced after processing the cover window CG about ten times.

The first film unit FL1 may process a second surface CG2 of the cover window CG as the polishing apparatus PA rotates around the first direction DR1. In an embodiment, the second surface CG2 may be an edge surface of the cover window CG. That is, the first film unit FL1 may process the edge surface of the cover window CG.

The second cushion unit CS2 may be disposed under the shank SK. In an embodiment, the second cushion unit CS2 may cover a lower portion of the shank SK, a lower portion of the first cushion unit CS1, and a lower portion of the first film unit FL1. However, the disclosure is not limited thereto. In an embodiment, the second cushion unit CS2 may cover only a portion of the lower portion of the shank SK and the lower portion of the first cushion unit CS1, for example.

The second cushion unit CS2 may include a first part CS2A and a second part CS2B. The first part CS2A may have a cylindrical shape. In an embodiment, a thickness of the first part CS2A in the first direction DR1 may be about 2 mm or more.

The second part CS2B may be disposed below the first part CS2A. The second part CS2B may have a conical shape protruding in a direction opposite to the first part CS2A. That is, the second cushion unit CS2 may have a shape in which a cylinder and a cone are stacked.

In an embodiment, an angle θ defined by a side surface of the second part CS2B and an imaginary line VL extending in the second direction DR2 may be about 3 degrees or more and about 20 degrees or less. Preferably, the angle defined by the side surface of the second part CS2B and the imaginary line VL may be about 5 degrees.

The second cushion unit CS2 may have a hardness of about Shore A20 or more and about Shore A30 or less. Preferably, the second cushion unit CS2 may have a hardness of about Shore A25. The second cushion unit CS2 may include rubber, silicon (Si), TPU, or the like. These materials may be used alone or in any combinations with each other.

Unlike the second film unit FL2, which will be described later, the second cushion unit CS2 may not wear even when the cover window CG is processed several times. That is, the second cushion unit CS2 may not be replaced even after processing the cover window CG several times.

The second film unit FL2 may cover the second part CS2B. The second film unit FL2 may include diamond powder, selenium dioxide (SeO2), silicon carbide (SiC), or the like. These materials may be used alone or in any combinations with each other.

The second film unit FL2 may directly contact the cover window CG when the polishing apparatus PA processes the cover window CG. Accordingly, the second film unit FL2 may be worn as the cover window CG is processed several times. Accordingly, the worn second film unit FL2 may be replaced with a new second film unit FL2. Preferably, the second film unit FL2 may be replaced after processing the cover window CG about 20 times.

The second film unit FL2 may process a first surface CG1 of the cover window CG as the polishing apparatus PA rotates around the first direction DR1. In an embodiment, the first surface CG1 may be a so-called 2.5D surface of the cover window CG. That is, the second film unit FL2 may process the 2.5D surface of the cover window CG. FIG. 3 is a view illustrating that the 2.5D surface includes a plane. However, the disclosure is not limited thereto. In an embodiment, the 2.5D surface may include a curved surface, for example.

Figure 4:
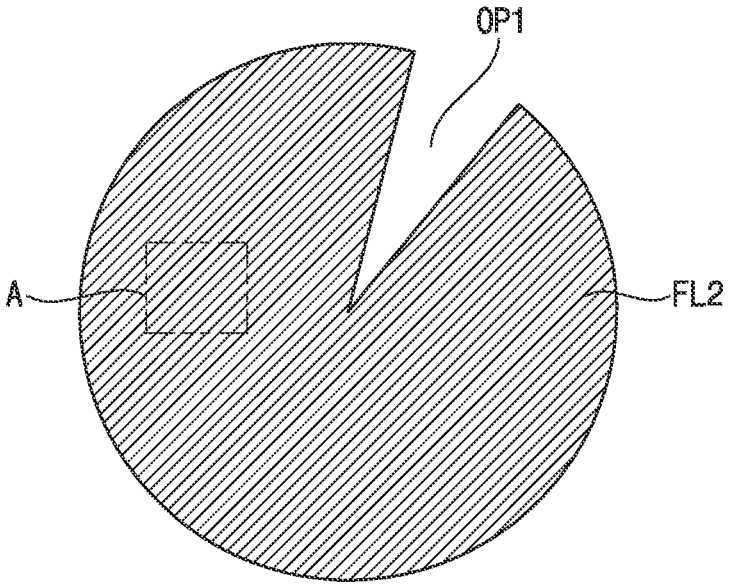
FIG. 4 is a diagram illustrating a development view of the second film unit of FIG. 1.

FIG. 4 is a diagram illustrating a development view of the second film unit of FIG. 1.

Referring to FIGS. 2 and 4, as described above, the second part CS2B may have a conical shape. Accordingly, a development view of the second film unit FL2 covering the second part CS2B may have a circle shape in which the first opening OP1 is defined as shown in FIG. 4. In an embodiment, the first opening OP1 may have a fan shape.

Figure 5:
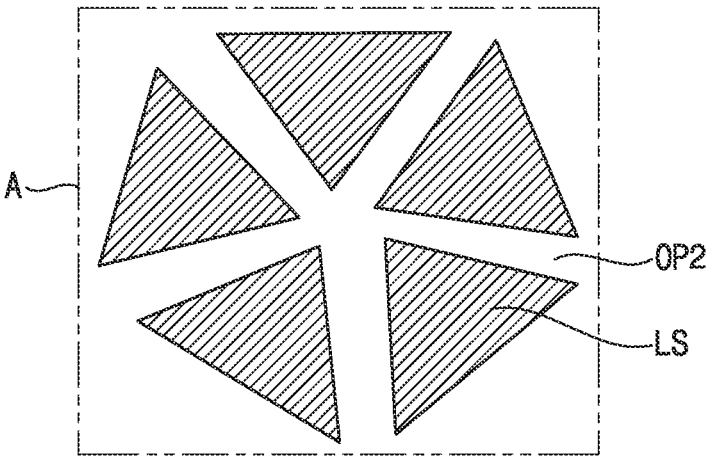
FIG. 5 is an enlarged view of part A of FIG. 4.

FIG. 5 is an enlarged view of part A of FIG. 4. Specifically, FIG. 5 is a diagram illustrating an enlarged view of the second film unit FL2 of FIG. 4 by about 500 times. FIG. 5 is an enlarged view of the second film unit FL2 of FIG. 4, but is not limited thereto, and may be an enlarged view of the first film unit FL1.

Referring to FIGS. 2 and 5, each of the first film unit FL1 and the second film unit FL2 may have a microstructure of a repeated lattice pattern LS. In addition, a second opening OP2 may be defined by the repeated lattice pattern LS. That is, the second opening OP2 may be an empty space surrounded by the lattice pattern LS.

In an embodiment, the lattice pattern LS may have a triangular shape. However, the disclosure is not limited thereto, and the lattice pattern LS may have a shape different from the shape of the triangle.

When the polishing apparatus PA processes the cover window CG, the first film unit FL1 and the second film unit FL2 may directly contact the cover window CG. In this case, fine foreign materials may be generated in the cover window CG, the first film unit FL1, or the second film unit FL2. The fine foreign materials may refer to fine particles that are separated from the cover window CG, the first film unit FL1, or the second film unit FL2 in a process of processing the cover window CG.

The fine foreign materials may be absorbed by the second opening OP2. That is, each of the first film unit FL1 and the second film unit FL2 has a triangular lattice-patterned microstructure, so that the fine foreign materials may be effectively removed or managed.

In the process of processing the cover window CG several times using the polishing apparatus PA of FIG. 1, the first film unit FL1 and the second film unit FL2 may be worn. In this case, when only the first film unit FL1 and the second film unit FL2 are replaced among the components included in the polishing apparatus PA, the cover window CG may be uniformly processed. Accordingly, the cost of processing the cover window CG may be reduced.

Figure 6:
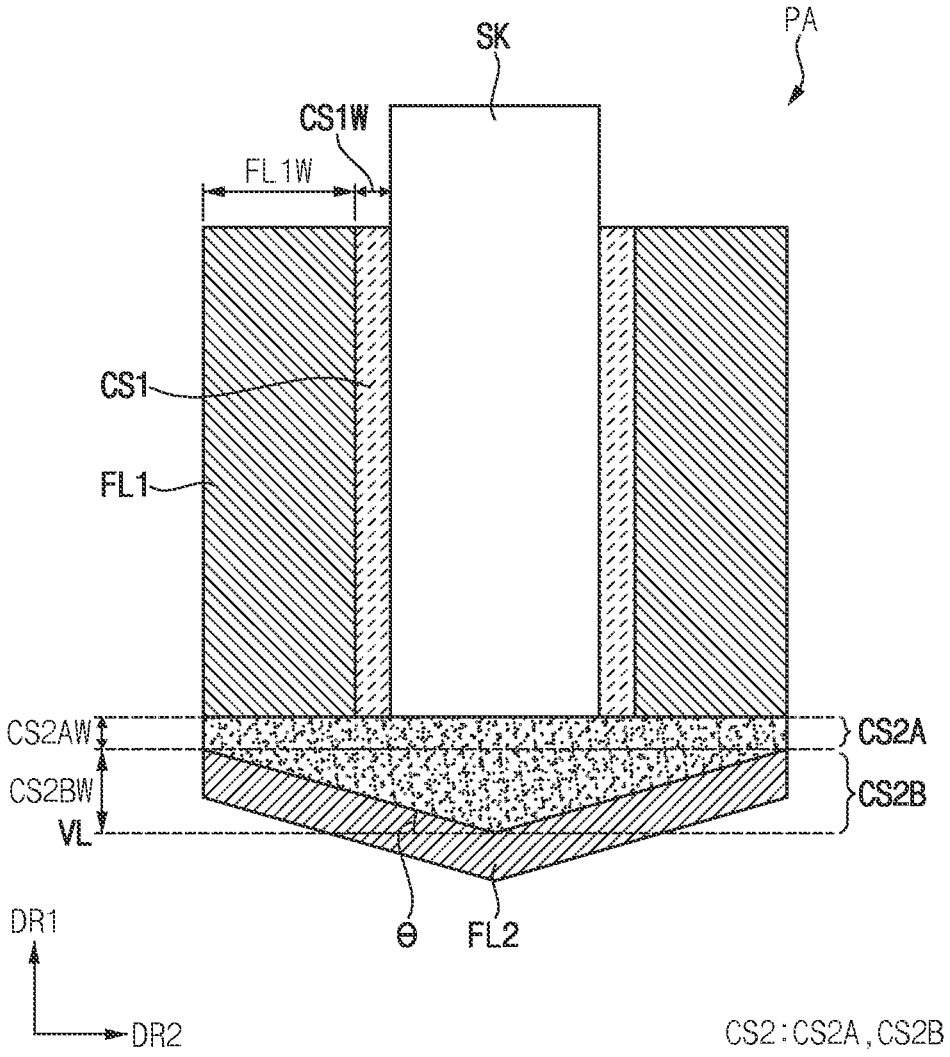
FIG. 6 is a cross-sectional view illustrating the polishing apparatus of FIG. 1.
Figure 7:
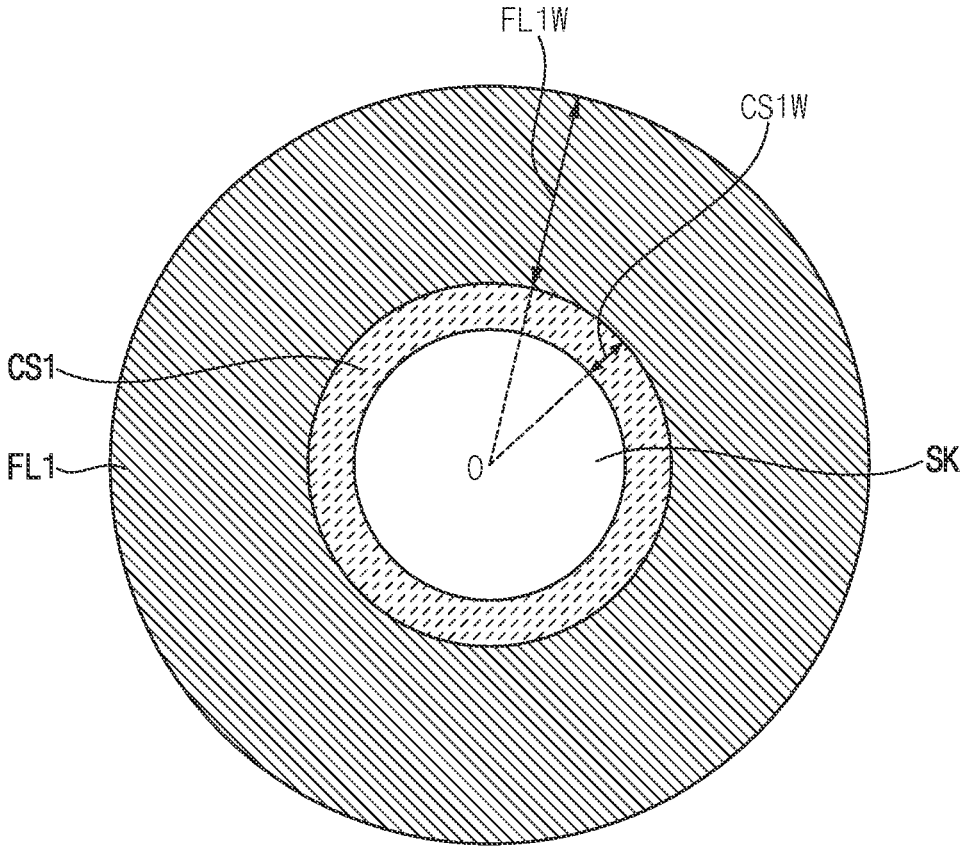
FIG. 7 is a plan view illustrating the polishing apparatus of FIG. 6.

FIG. 6 is a cross-sectional view illustrating the polishing apparatus of FIG. 1. FIG. 7 is a plan view illustrating the polishing apparatus of FIG. 6.

Referring to FIGS. 6 and 7, the first cushion unit CS1 may have a first cushion unit thickness CS1W in the second direction DR2. In addition, the first film unit FL1 may have a first film unit thickness FL1W in the second direction DR2. In an embodiment, the first film unit thickness FL1W may be greater than the first cushion unit thickness CS1W.

The first part CS2A may have a first part thickness CS2AW in the first direction DR1. In addition, a central portion of the second part CS2B may have a second part thickness CS2BW in the first direction DR1. In an embodiment, the second part thickness CS2BW may be greater than the first part thickness CS2AW. In FIG. 7, a point O may be a center portion of the shank SK in a plan view.

Figure 8:
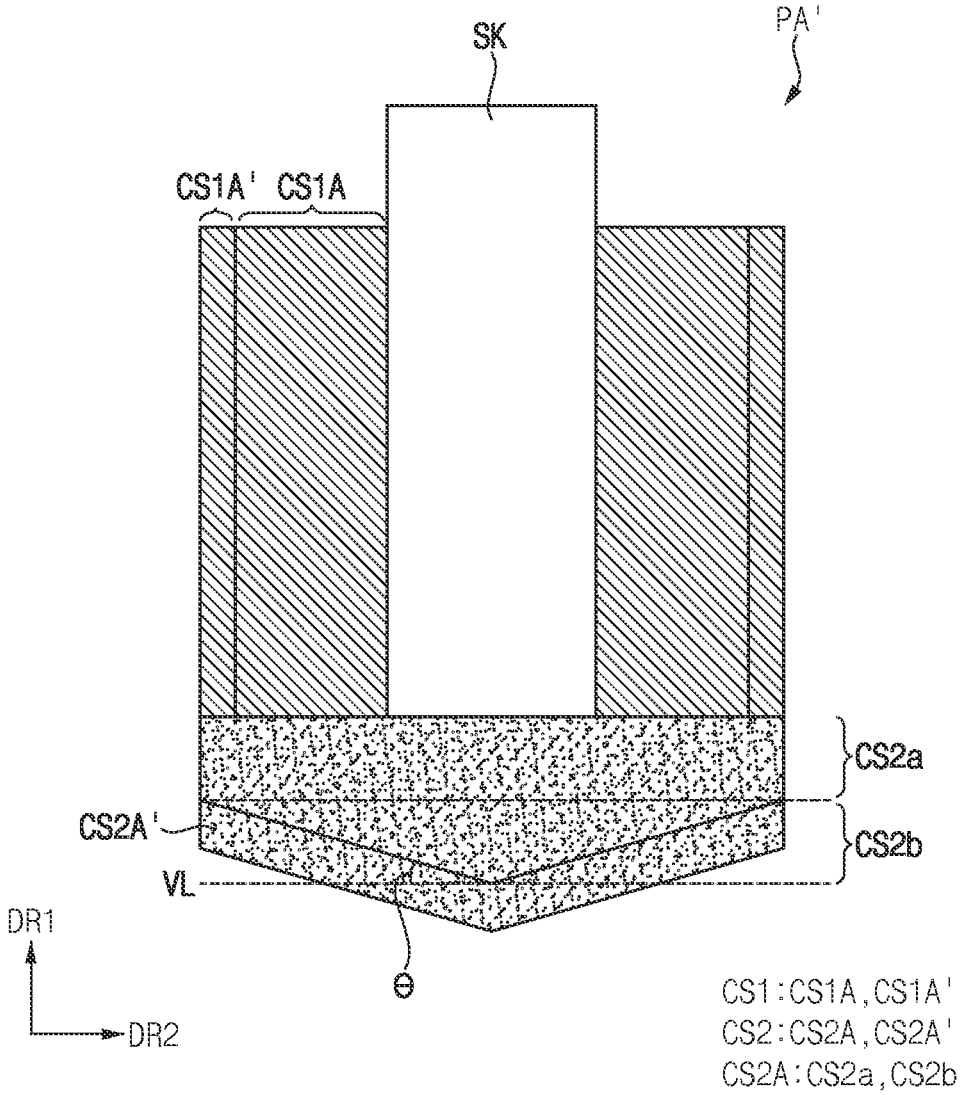
FIG. 8 is a cross-sectional view illustrating another embodiment of a polishing apparatus.

FIG. 8 is a cross-sectional view illustrating another embodiment of a polishing apparatus. In an embodiment, FIG. 8 may be a cross-sectional view taken along a perforated line passing through another embodiment of a central portion of the polishing apparatus PA', for example. In describing the polishing apparatus PA' of FIG. 8, detailed descriptions of substantially the same components as the polishing device PA of FIG. 2 may be omitted.

Referring to FIG. 8, a polishing apparatus PA' in another embodiment may include a first cushion unit CS1 and a second cushion unit CS2. The first cushion unit CS1 may include a shank SK, a first core CS1A, and a first processing part CS1A'. In addition, the second cushion unit CS2 may include a second core CS2A and a second processing part CS2A'.

A first core CS1A may cover a side surface of the shank SK. That is, the first core CS1A may be adjacent to the shank SK in a second direction DR2. In an embodiment, the first core CS1A may have a cylindrical shape. That is, the first core CS1A may have a cylindrical shape through which the shank SK penetrates at a central portion of the cylindrical shape.

The first core CS1A may have a hardness of about Shore A40 or more and about Shore A50 or less. Preferably, the first core CS1A may have a hardness of about Shore A45. In an embodiment, a thickness of the first core CS1A in the second direction DR2 may be about 2 mm or more.

The first core CS1A may include rubber, silicon (Si), TPU, or the like. These materials may be used alone or in any combinations with each other.

Unlike the first processing part CS1A' to be described later, the first core CS1A may not wear even when the cover window (e.g., the cover window CG of FIG. 3) is processed several times. That is, the first core CS1A may not be replaced even after processing the cover window several times.

The first processing part CS1A' may cover a side surface of the first core CS1A. That is, the first processing part CS1A' may be adjacent to the first core CS1A in the second direction DR2. In an embodiment, the first processing part CS1A' may have a cylindrical shape. That is, the first processing part CS1A' may have a cylindrical shape through which the shank SK and the first core CS1A pass at the central portion of the cylindrical shape.

The first processing part CS1A' may include rubber, silicon (Si), TPU, or the like. These materials may be used alone or in any combinations with each other. In an embodiment, the first processing part CS1A' may further include a diamond powder.

The first processing part CS1A' may directly contact the cover window when the polishing apparatus PA' processes the cover window. Accordingly, the first processing part CS1A' may be worn as the cover window is processed several times. When the first processing part CS1A' is worn, the first cushion unit CS1 may be replaced. That is, not only the first processing part CS1A' but also the first core CS1A may be replaced.

The first processing part CS1A' may process a second surface (e.g., the second surface CG2 of FIG. 3) of the cover window as the polishing apparatus PA' rotates around the first direction DR1. In an embodiment, the second surface may be an edge surface of the cover window. That is, the first processing part CS1A' may process the edge surface of the cover window.

A second core CS2A may be disposed under the shank SK. In an embodiment, the second core CS2A may cover a lower portion of the shank SK, a lower portion of the first core CS1A, and a lower portion of the first processing part CS1A'. However, the disclosure is not limited thereto. In an embodiment, the second core CS2A may cover only a portion of the lower portion of the shank SK and the lower portion of the first core CS1A, for example.

The second core CS2A may include a first part CS2*a* and a second part CS2*b*. The first part CS2*a* may have a cylindrical shape. In an embodiment, a thickness of the first part CS2*a* in the first direction DR1 may be about 2 mm or more.

The second part CS2*b* may be disposed below the first part CS2*a*. The second part CS2*b* may have a conical shape protruding in a direction opposite to the first part CS2*a*. That is, the second core CS2A may have a shape in which a cylinder and a cone are stacked.

In an embodiment, an angle defined by a side surface of the second part CS2*b* and an imaginary line VL extending in the second direction DR2 may be about 3 degrees or more and about 20 degrees or less. Preferably, the angle defined by the side surface of the second part CS2*b* and the imaginary line VL may be about 5 degrees.

The second core CS2A may have a hardness of about Shore A20 or more and about Shore A30 or less. Preferably, the second core CS2A may have a hardness of about Shore A25. The second core CS2A may include rubber, silicon (Si), TPU, or the like. These materials may be used alone or in any combinations with each other.

Unlike the second processing part CS2A' to be described later, the second core CS2A may not be worn even when the cover window is processed several times. That is, the second core CS2A may not be replaced even after processing the cover window several times.

The second processing part CS2A' may cover the second part CS2*b*. The second processing part CS2A' may include rubber, silicon (Si), TPU, or the like. These materials may be used alone or in any combinations with each other. In an embodiment, the second processing unit CS2A' may further include a diamond powder.

The second processing part CS2A' may directly contact the cover window when the polishing apparatus PA' processes the cover window. Accordingly, the second processing part CS2A' may be worn as the cover window is processed several times. When the second processing part CS2A' is worn, the second cushion unit CS2 may be replaced. That is, not only the second processing part CS2A' but also the second core CS2A may be replaced.

The second processing part CS2A' may process the first surface (e.g., the first surface CG1 of FIG. 3) of the cover window as the polishing apparatus PA' rotates around the first direction DR1. In an embodiment, the first surface may be a so-called 2.5D surface of the cover window. That is, the second processing part CS2A' may process the 2.5D surface of the cover window.

The disclosure may be applied to various polishing apparatuses. In an embodiment, the disclosure is applicable to various polishing apparatuses such as polishing apparatuses for vehicles, ships and aircraft, portable communication devices, display devices for exhibition or information transmission, medical display devices, or the like.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the inventive concept. Accordingly, all such modifications are intended to be included within the scope of the inventive concept as defined in the claims. Therefore, it is to be understood that the foregoing is illustrative of various embodiments and is not to be construed as limited to the illustrative embodiments disclosed, and that modifications to the disclosed embodiments, as well as other embodiments, are intended to be included within the scope of the appended claims.

What is claimed is:

1. A polishing apparatus comprising:

a shank including a rotation shaft extending in a first direction;

a first cushion unit covering a side surface of the shank and having a first hardness;

a first film unit adjacent to the first cushion unit in a second direction crossing the first direction and covering a side surface of the first cushion unit;

a second cushion unit disposed below the shank, having a second hardness different from the first hardness, and including a first part and a second part, wherein the first part has a cylindrical shape and the second part is disposed below the first part and has a conical shape protruding in a direction opposite to the first part; and a second film unit covering the second part.

2. The polishing apparatus of claim 1, wherein the first hardness is greater than the second hardness.

3. The polishing apparatus of claim 2, wherein the first hardness is about Shore A40 or more and about Shore A50 or less.

4. The polishing apparatus of claim 3, wherein the second hardness is about Shore A20 or more and about Shore A30 or less.

5. The polishing apparatus of claim 1, wherein each of the first film unit and the second film unit has a microstructure of a repeated triangular lattice pattern.

6. The polishing apparatus of claim 1, wherein an angle defined by a side surface of the second part and the second direction is about 3 degrees or more and about 20 degrees or less.

7. The polishing apparatus of claim 1, wherein the second cushion unit covers a lower portion of the shank, a lower portion of the first cushion unit, and a lower portion of the first film unit.

8. The polishing apparatus of claim 1, wherein the shank has a cylindrical shape.

9. The polishing apparatus of claim 1, wherein a thickness of the first cushion unit in the second direction is about 2 millimeters or more.

10. The polishing apparatus of claim 9, wherein a thickness of the first part in the first direction is about 2 millimeters or more.

11. The polishing apparatus of claim 1, wherein a thickness of the first film unit in the second direction is greater than a thickness of the first cushion unit in the second direction.

12. The polishing apparatus of claim 11, wherein a thickness of a central portion of the second part in the first direction is greater than a thickness of the first part in the first direction.

13. The polishing apparatus f claim 1, wherein each of the first cushion unit and the second cushion unit includes at least one of rubber, silicon (Si), and thermoplastic polyurethane.

14. The polishing apparatus of claim 1, wherein each of the first film unit and the second film unit includes at least one of diamond powder, selenium dioxide (SeO2), and silicon carbide (SiC).

15. A polishing apparatus comprising:

a shank including a rotation shaft extending in a first direction;

a first cushion unit including a first core covering a side surface of the shank and a first processing part covering a side surface of the first core, wherein the first core has a first hardness; and a second cushion unit disposed below the shank, having a second hardness different from the first hardness, and including a second core and a second processing part, wherein the second core has a first part and a second part disposed below the first part and the second processing part covers the second part, wherein the first part has a cylindrical shape and the second part has a conical shape.

16. The polishing apparatus of claim 15, wherein the first hardness is greater than the second hardness.

17. The polishing apparatus of claim 16, wherein the first hardness is about Shore A40 more and about Shore A50 or less.

18. The polishing apparatus of claim 17, wherein the second hardness is about Shore A20 or more and about Shore A30 or less.

19. The polishing apparatus of claim 15, wherein each of the first core and the second core includes at least one of rubber, silicon (Si), and thermoplastic polyurethane.

20. The polishing apparatus of claim 15, wherein each of the first processing part and the second processing part includes diamond powder and at least one of rubber, silicon (Si), and thermoplastic polyurethane.

* * * * *